US006219514B1

(12) United States Patent
Kobayashi et al.

(10) Patent No.: US 6,219,514 B1
(45) Date of Patent: Apr. 17, 2001

(54) IMAGE FORMING APPARATUS AND POSITIONING OF MAGNETIC FIELD GENERATING DEVICES WITHIN THE SAME APPARATUS

(75) Inventors: Yoshiaki Kobayashi, Numazu; Masaru Hibino, Minami Ashigara; Masanori Shida, Shizuoka-ken; Ichiro Ozawa, Funabashi, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/432,798

(22) Filed: Nov. 3, 1999

(30) Foreign Application Priority Data

Nov. 6, 1998 (JP) ..... 10-331966

(51) Int. Cl.[7] ..... G03G 15/00
(52) U.S. Cl. ..... 399/277; 399/175
(58) Field of Search ..... 399/277, 175, 399/174, 168, 176

(56) References Cited

U.S. PATENT DOCUMENTS 4,941,019 7/1990 Honda et al. ..... 355/251
5,351,109 * 9/1994 Haneda ..... 399/175
5,438,394 8/1995 Suzuki et al. ..... 355/251
5,576,812 11/1996 Hibino et al. ..... 355/251
5,659,852 * 8/1997 Chigono et al. ..... 399/175

* cited by examiner

*Primary Examiner*—Quana M. Grainger
(74) *Attorney, Agent, or Firm*—Fitzpatrick, Cella, Harper & Scinto

(57) ABSTRACT

An image forming apparatus comprises a charging member, an image bearing member and a developer bearing member. The charging member comprises a first magnetic field generating device, wherein a first magnetic field with a first magnetic pole closest to the image bearing member has a half-value width α°. Measuring from a center of the charging member, an angle between a closest point of the image bearing member and a maximum magnetic flux density of the first magnetic pole is θc°. The developer bearing member comprises a second magnetic field generating device, wherein a second magnetic field with a second magnetic pole closest to the image bearing member has a half-value width β°. Measuring from a center of the developer bearing member, an angle between a closest point of the image bearing member and a maximum magnetic flux density of the second magnetic pole is θd°. The charging member, developer bearing member and image bearing member are arranged so that α>β and θc<θd.

9 Claims, 8 Drawing Sheets

IMAGE FORMING APPARATUS AND POSITIONING OF MAGNETIC FIELD GENERATING DEVICES WITHIN THE SAME APPARATUS

BACKGROUND OF THE INVENTION

1. Field of the Invention

The present invention relates to an image forming apparatus such as an electrophotographic copying apparatus, for example, a copying apparatus or a laser beam printer, and an electrostatic recording apparatus. More particularly, the present invention relates to an image forming apparatus for obtaining an image by developing an electrostatic latent image formed onto an image bearing member by toner.

2. Related Background Art

FIG. 5 is a schematic block diagram showing an image forming apparatus, and the operation thereof will be simply described.

First, an original G is put on an original mount 10 so that the surface to be copied of the original G faces downward. Next, a copy button is pressed, thereby starting the copying operation. The original G is scanned in the direction of an arrow by a unit 9 constructed integrally by a lamp for irradiating the original, a short focus lens array, and a CCD sensor while being irradiated by the unit 9. The short focus lens array forms an image of original surface reflection light of the irradiation scanning light, and the formed image is inputted to the CCD sensor.

The CCD sensor is made up of: a light receiving unit; a transfer unit; and an output unit.

An optical signal is converted into a charged signal by the CCD light receiving unit, and the charged signal is synchronized with a clock pulse and sequentially transferred to the output unit by the transfer unit. In the output unit, the charged signal is converted into a voltage signal and amplified, and the impedance of the amplified signal is decreased, thereby outputting the signal. The voltage signal (analog signal) obtained in the above-mentioned manner is subjected to well-known image-processing, converted into a digital signal, and transmitted to a printer unit.

In the printer unit, the foregoing image signal is received and an electrostatic latent image is formed as follows. A photosensitive drum 1 is driven to rotate at a predetermined circumferential velocity in the direction of an arrow A while setting a spindle la as a center. In the rotating process, the surface is first subjected to a charging process uniformly so as to have a voltage of about −650 V by a charger 3. The uniformly charged surface is scanned by light of a solid laser element for emitting light switched on/off in reply to the image signal with a rotary polygon mirror 104 (in FIG. 6) that rotates at a high speed, and thereby sequentially forms an electrostatic latent image for which the surface potential is attenuated to about −200 V in correspondence with the original image onto the surface of the photosensitive drum 1.

FIG. 6 is a schematic block diagram showing the structure of a laser scanning unit 100 for scanning laser beams in the image forming apparatus. When scanning the laser beams with the laser scanning unit 100, a solid laser element 102 is first flickered at a predetermined timing on the basis of an inputted image signal by a light emitting signal generating device 101.

The laser beams irradiated from the solid laser element 102 are converted into luminous flux that are substantially in parallel to each other with a collimator lens system 103.

Further, the beams are scanned toward the direction of an arrow C with the rotary polygon mirror 104 rotating in the direction of an arrow B. The image is also formed onto a spot of a surface to be scanned 106 of a photosensitive drum or the like through an fθ-lens group of 105*a,* 105*b,* and 105*c.*

The laser beams are scanned as mentioned above and, therefore, exposure distribution corresponding to one scanning of the image is formed on the surface to be scanned 106. Further, if the surface to be scanned 106 is scrolled in the direction vertical to the scanning direction by a predetermined quantity in every scanning, exposure distribution can be obtained on the surface to be scanned 106 in response to the image signal.

Next, a developing step will now be described. Generally, there are four kinds of developing methods as follows.

(1) A method of coating non-magnetic toner onto a sleeve by a blade or the like, and coating magnetic toner onto the sleeve by magnetic force and carrying them, thereby developing the toner to the photosensitive drum 1 in a non-contact state (one-component non-contact developing)

(2) A method of developing the toner coated as mentioned above to the photosensitive drum in a contact state (one-component contact developing)

(3) A method of mixing magnetic carriers with toner particles, using them as the developer, and carrying them by magnetic force, thereby developing an image to a photosensitive drum in a contact state (two-component contact developing)

(4) A method of developing the foregoing two-component developer in a non-contact state (two-component non-contact developing)

It is easy to obtain a halftone image having high resolution. Consequently, there has been frequently used, for an image forming apparatus requiring a high picture quality, the two-component contact developing method such that the mixture of the toner particles and the magnetic carriers are used as the developer, and the image is developed in the contact state with the photosensitive drum such as a full-color copying apparatus.

A developing device 4 has a developer container 16 as shown in FIG. 7. The inside of the developer container 16 is partitioned to a developing chamber (first chamber) R1 and an agitating chamber (second chamber) R2 by a partitioning wall 17. Supply toner (non-magnetic toner) 18 is contained in a toner storage chamber R3. A supply port 20 is provided to the partitioning wall 17, and the supply toner 18 in an amount corresponding to consumed toner is dropped and supplied into the agitating chamber R2 through the supply port 20.

On the other hand, a developer 19 is contained in the developing chamber R1 and agitating chamber R2. The developer 19 is a two-component developer having non-magnetic toner and magnetic particles (carriers) (as a mixing ratio, the ratio of the non-magnetic toner is set to about 4% to 10% by weight). The non-magnetic toner has a volume mean particle diameter of about 5 to 15 $\mu$m. The magnetic particles are comprised of ferrite particles that have been resin-coated, resin particles to which a magnetic substance has been dispersed, or the like. As for the magnetic particles, the weight mean particle diameter is equal to 25 to 60 $\mu$m, the volume resistivity is equal to $10^6$ to $10^{13}$ Ω·cm, and the transmittivity of the magnetic particles is equal to 2.5 to 5.0.

An opening portion is provided to a region that is close to the photosensitive drum 1 of the developer container 16, and a developing sleeve 11 is provided so as to be projected toward the outer side from the opening portion. The developing sleeve 11 is rotatably assembled in the developer container 16. The outer diameter dimension of the developing sleeve 11 is equal to 32 mm. The circumferential velocity of the developing sleeve 11 is equal to 280 mm/sec and the developing sleeve 11 is rotated in the direction of an arrow in the drawing. An interval Da between the developing sleeve 11 and the photosensitive drum 1 is arranged so as to have a distance of almost 500 $\mu$m. The developing sleeve 11 is made of non-magnetic material, and a magnet 12 serving as magnetic field generating means is fixed into the developing sleeve 11.

The magnet 12 has: a developing magnetic pole S1; a magnetic pole N3 located downstream from the developing magnetic pole S1; and magnetic poles N2, S2, and N1 for carrying the developer 19. The magnet 12 is arranged in the developing sleeve 11 so that the developing magnetic pole S1 almost faces to the photosensitive drum 1. The developing magnetic pole S1 forms a magnetic field near a developed portion between the developing sleeve 11 and photosensitive drum 1, and a magnetic brush is formed by the formed magnetic field.

A blade 15 is disposed in the upper direction of the developing sleeve 11 at a predetermined interval T between the blade 15 and the developing sleeve 11. The interval T therebetween is equal to almost 800 $\mu$m, and the blade 15 is fixed to the developer container 16. The blade 15 is made of non-magnetic material such as aluminum and SUS316, and regulates the layer thickness of the developer 19 on the developing sleeve 11.

A carrying screw 13 is contained in the developing chamber R1. The carrying screw 13 is rotated in the direction of an arrow. By the rotation, the developer 19 in the developing chamber R1 is carried toward the longitudinal direction of the developing sleeve 11.

A carrying screw 14 is contained in the storage chamber R2. The carrying screw 14 is rotated in the direction of an arrow, and the toner is carried along the longitudinal direction of the developing sleeve 11.

The developing sleeve 11 bears the developer at the position near the magnetic pole N2. The developer 19 is carried toward the developed portion in accordance with the rotation of the developing sleeve 11. When the developer 19 reaches the portion near the developed portion, the magnetic particles of the developer 19 are coupled by the magnetic force of the magnetic pole S1 and then raised from the developing sleeve 11, thereby forming the magnetic brush of the developer 19.

As a developing system, a reversal developing system is adopted. A DC voltage and an alternating voltage are applied to the developing sleeve 11 from a power source (not shown). In the example shown in the drawing, a voltage of −500 V as a DC voltage and a voltage of Vpp=2,000 V as an alternating voltage are applied, and a rectangular wave of Vf=2,000 Hz is applied.

Generally, developing efficiency is increased and an image has a high quality when applying an alternating voltage. On the contrary, there might be caused a danger that fog is easily generated. Therefore, a potential difference is normally set between the DC voltage applied to the developing device 4 and the surface potential of the photosensitive drum 1, thereby realizing the prevention of fog. In the drawing, the potential for preventing fog is a potential difference of 150 V between a potential of −650 V charged uniformly first and a DC voltage proportion of −500 V applied to the developing sleeve 11.

On the other hand, a contrast potential is a potential to adhere the toner to the photosensitive drum 1 from the developing sleeve. The contrast potential is a difference potential of 300 V between a potential of −200 V that has been exposed and attenuated and a DC potential proportion of −500 V of the voltage that is applied to the developing sleeve 11. As discussed above, the toner image formed on the photosensitive drum 1 is electrostatically transferred onto a transfer material by a transfer charger 7. After that, the transfer material is electrostatically separated by a separate charger 8 and conveyed to a fixing device 6, thereby thermally fixing and outputting the image.

The surface of the photosensitive drum 1 after transferring the toner image is subjected to a process for removing adhered stains such as remaining transfer toner by a cleaner 5, and repeatedly used for image formation.

In recent years, concern for the environment has been raised and, as for a charging method without using corona discharge, a direct charging member has been used. Particularly, an injection electrifying system is extremely excellent as a system by which a discharge amount is extremely small at the time of charging the surface of a photosensitive drum. According to the injection electrifying system, electric charges are injected to a trap potential which the surface material of the photosensitive drum has, by a contact charging member, thereby charging, or an electric charge injecting layer in which conductive particles are dispersed is provided to the surface of the photosensitive drum and charges are applied to the conductive particles by the contact charging member, thereby charging.

In this case, the volume resistivity of the surface layer of the photosensitive drum is set to about $10^9$ to $10^{14}$ Ω·cm. It is known that when superimposing an alternating electric field to a bias to be applied to the contact charging member, charging efficiency is increased and the long life of the contact charging member can be attained. It is also known that it is preferable to use the following alternating electric field. That is, as for the alternating electric filed which is superimposed, a peak-to-peak voltage, that is, Vpp is equal to 500 V or more, preferably, equal to 700 V or more, and a frequency thereof lies within a range of 300 to 5,000 Hz, preferably, 500 to 2,000 Hz.

However, there is a problem in that fog is generated in the image and only the outputted image having low density is obtained according to the injection electrifying system in the following case. That is, according to the injection electrifying system, in order to realize the long life of the contact charging member and obtain preferable charging performance, the alternating electric field is superimposed to the bias applied to the contact charging member by using the photosensitive drum whose surface layer as described above is adjusted so as to have a volume resistivity of about $10^9$ to $10^{14}$ Ω·cm and the photosensitive drum is uniformly charged. After that, an electrostatic latent image is formed by exposing the image and developed by the foregoing two-component developing method, thereby forming the image.

The inventors of the present invention have made various investigations about phenomena in which the fog is generated and a decrease in image density occurs. As a result, it is determined that the phenomena occur by injecting charges to the photosensitive drum whose surface layer has the volume resistivity of about $10^9$ to $10^{14}$ Ω·cm from the magnetic carriers upon developing.

The following is necessary to accomplish a preferable injection electrifying for the photosensitive drum whose surface layer has the volume resistivity of about $10^9$ to $10^{14}$ Ω·cm as schematically explained above. That is, as for magnetic particles for injection electrifying, there are used ferrite particles whose volume resistivity is equal to $10^{10}$ Ω·cm or less and whose weight mean diameter is equal to almost 100 μm or less, preferably, equal to 15 to 50 μm or the like. The magnetic particles in a coated state of almost 100 mg/cm$^2$ or more are born on the surface of the charging sleeve including therein the magnet. While holding an interval of almost 500 μm between the charging sleeve and the photosensitive drum 1 and rubbing the magnetic particles to the charging sleeve, there is applied the DC voltage which is almost equal to a target potential to be charged. There is also applied the alternating voltage as the voltage Vpp which is equal to 500 V or more, preferably 700 V or more, and the frequency which lies within a range of 300 to 5,000 Hz, preferably, 500 to 2,000 Hz.

In this instance, a state where the magnetic particle layer comes into contact with the photosensitive drum is very important in order to certainly bear and carry the magnetic particles without transferring the magnetic particles from the charging sleeve to the photosensitive drum (adhering carriers), to uniformly charge the surface of the charging sleeve, and to assure a sufficient injecting time. Factors to determine the state are the magnet included in the charging sleeve as described above, in particular, a position of the magnetic pole (referred to as a charging pole, hereinafter) arranged close to a portion opposite to the photosensitive drum and a half-value width as shown in FIG. 4A (angle of an area showing a half value of the maximum magnetic flux density of the magnetic pole).

In other words, in order to enable the sufficient charging time and the uniform charging without adhering carrier, the position of the magnetic pole of the charging pole is made extremely close to the portion that is the closest to the photosensitive drum (for example, 5° from the closest portion on the upstream side in the rotational direction of the photosensitive drum) and the half-value width is widened.

As expressed above, according to the two-component developing method, the developer comprising the non-magnetic toner and the magnetic carriers having the volume resistivity of about $10^6$ to $10^{13}$ Ω·cm is born and carried on the rotatable developing sleeve including therein the magnet. While rubbing the developer to the photosensitive drum at the portion that is almost opposite to the photosensitive drum under the developing bias as described in the above-mentioned example, only the non-magnetic toner is transferred to the photosensitive drum without transferring the magnetic carriers (adhering the carrier) and the image is developed so as to enable a sufficient image density and assure image quality. In this instance, as with the foregoing charge, important parameters for developing performance include the position of the magnetic pole (referred to as a developing pole, hereinafter) which is close to the opposite portion of the photosensitive drum, and the half-value width as shown in FIG. 4B (angle of the area that is indicative of a ½-value of the maximum magnetic flux density of the magnetic pole).

That is, to carry the developer certainly without adhering any carrier, a peak position (having a maximum magnetic carrying force) of the developing pole is made extremely close to the position opposite to the photosensitive drum (for example, 2° from the closest portion on the upstream side in the rotational direction of the photosensitive drum), and the half-value width is widened so that the developing time (abutting width for developing) for image density is increased.

If it is exemplified that the volume resistivity of the magnetic carriers is equal to that of the magnetic particles for charging or less, in the structure of the developing device, a rubbing state of the portion opposite to the photosensitive drum is very similar to that of the injection charger, thereby causing an electric charge injection phenomenon in the developed portion.

Upon causing the electric charge injection phenomenon in the developed portion, in both the white portion (white ground portion) and the black portion (black ground portion), the potentials are converged to a DC component of a voltage applied to the developing sleeve. The white portion is a portion that is uniformly charged to the photosensitive drum, and thereafter, not exposed. The black portion is a portion that is uniformly charged to the photosensitive drum and, thereafter, exposed. Therefore, it is founded that a potential difference between the white portion and the developing sleeve is decreased, the fog is generated, a potential difference between the black portion and the developing sleeve is also decreased, and consequently, the image density is dropped.

The phenomenon remarkably occurs in the foregoing case where an angle formed between the developing pole and the closest contact point of the developing sleeve and the photosensitive drum on the developing sleeve is smaller than an angle formed between the charging pole and the closest contact point of the charging sleeve and photosensitive drum on the charging sleeve, and the half-value width of the developing pole is larger than that of the charging pole.

SUMMARY OF THE INVENTION

It is an object of the invention to optimize the relationship between a charging pole of a charging member and a developing pole of a developer bearing member so as to prevent the occurrence of fog and decrease in image density.

Further, it is an object of the invention to provide an image forming apparatus comprising: an image bearing member for bearing a latent image, the image bearing member including a surface layer having volume resistivity of $10^9$ to $10^{14}$ Ω·cm; a charging member having therein a first magnetic field generating means, the charging member bearing magnetic particles on the outer surface and making the magnetic particles contact with the surface layer of the image bearing member, thereby charging the image bearing member; and a developer bearing member having therein a second magnetic field means, the developer bearing member bearing a developer having toner and magnetic particles on an outer surface, carrying the developer to a developing area, and making the magnetic particles contact with the surface layer of the image bearing member in the developing area, thereby developing the latent image, wherein when a half-value width of a first magnetic pole which is the closest to the image bearing member of the first magnetic field generating means is set to α°, an angle formed between a straight line connecting between a point that is the closest to the image bearing member on the charging member and a center of the charging member and a straight line connecting between a point of a maximum magnetic flux density of the first magnetic pole on the charging member and the center of the charging member is set to θc°, a half-value width of a second magnetic pole that is the closest to the image bearing member of the second magnetic field generating means is set to β°, and an angle formed between a straight line connecting a point that is the closest to the image bearing member on the developer bearing member and a center of the developer bearing member and a straight line connecting between a point of a maximum magnetic flux density of the second magnetic pole on the developer bearing member and a center of the image bearing member is set to θd°, α>β and θc<θd are satisfied.

The other objects and features of the present invention will be become apparent from the following detailed description with reference to the accompanying drawings.

BRIEF DESCRIPTION OF THE DRAWINGS

FIG. 4A is a diagram showing the half-value width of the charging pole; and FIG. 4B is a diagram showing the half-value width of the developing pole;

DESCRIPTION OF THE PREFERRED EMBODIMENT

An embodiment of the present invention will be now described hereinbelow with reference to the accompanying drawings.

Embodiment 1

First, features of the present invention will be explained. The inventors of the present invention have found relationships in an image forming apparatus including a photosensitive drum serving as an image bearing member in which the volume resistivity of a surface layer for injection electrifying is adjusted so as to be equal to about $10^9$ to $10^{14}$ Ω·cm and a developing device using the two-component developer having magnetic carriers whose volume resistivity is equal to about $10^6$ to $10^{13}$ Ω·cm. In other words, there is a relationship between a half-value width of a developing pole of a developing unit and a half-value width of a charging pole of an injection charger to solve the problem in that a potential difference between a white portion and a developing sleeve is decreased and fog is generated and a potential difference between a black portion and a developing sleeve and image density is decreased upon developing. There is also a relationship between an angle formed between the charging pole and the closest contact point of the charging sleeve and the photosensitive drum on the charging sleeve and an angle formed between the developing pole and the closest contact point of the developing sleeve and the photosensitive drum on the developing sleeve.

That is, according to the investigations by the inventors of the present invention, where α(°) (degrees) denotes the half-value width of the charging pole; θc(°) denotes the angle formed between the charging pole peak position and the closest contact point with the photosensitive drum on the charging sleeve; β(°) denotes the half-value width of the developing pole; and θd(°) denotes the angle formed between the developing pole peak position and the closest contact point with the photosensitive drum on the developing sleeve, both inequalities of α>β and θc<θd are satisfied. Therefore, it is determined that the foregoing problems can be solved.

Figure 3:
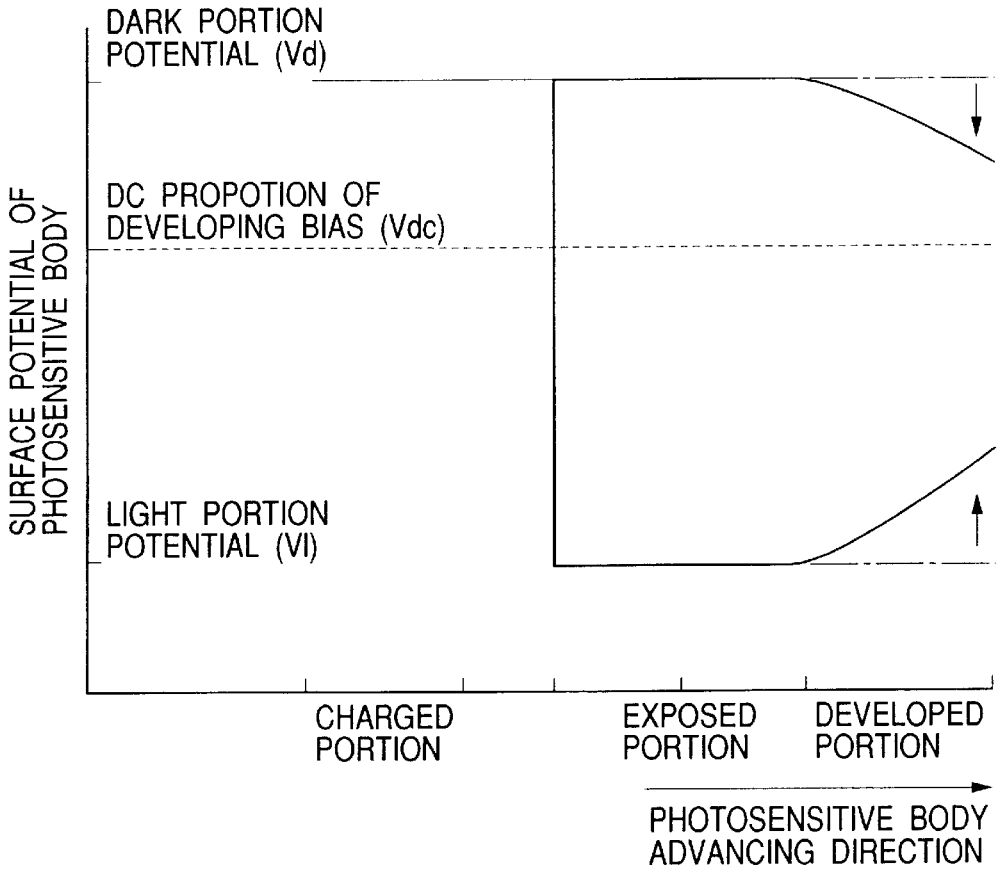
FIG. 3 is a view showing a change in a developed portion of a surface potential of a photosensitive body as described as a problem according to the present invention.
Figure 4A:
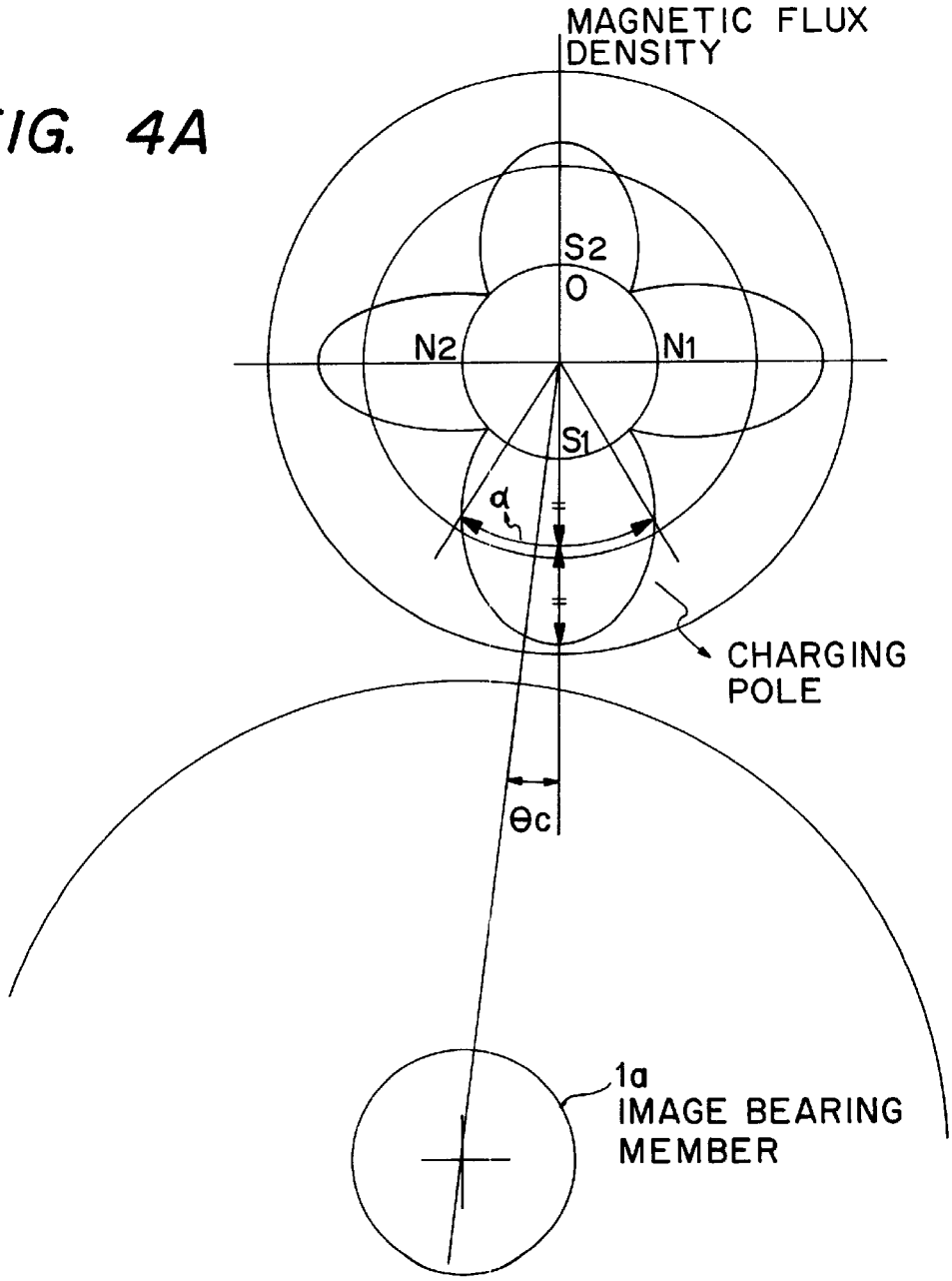
FIGS. 4A and 4B are diagrams showing half-value widths as described in the present invention.
Figure 4B:
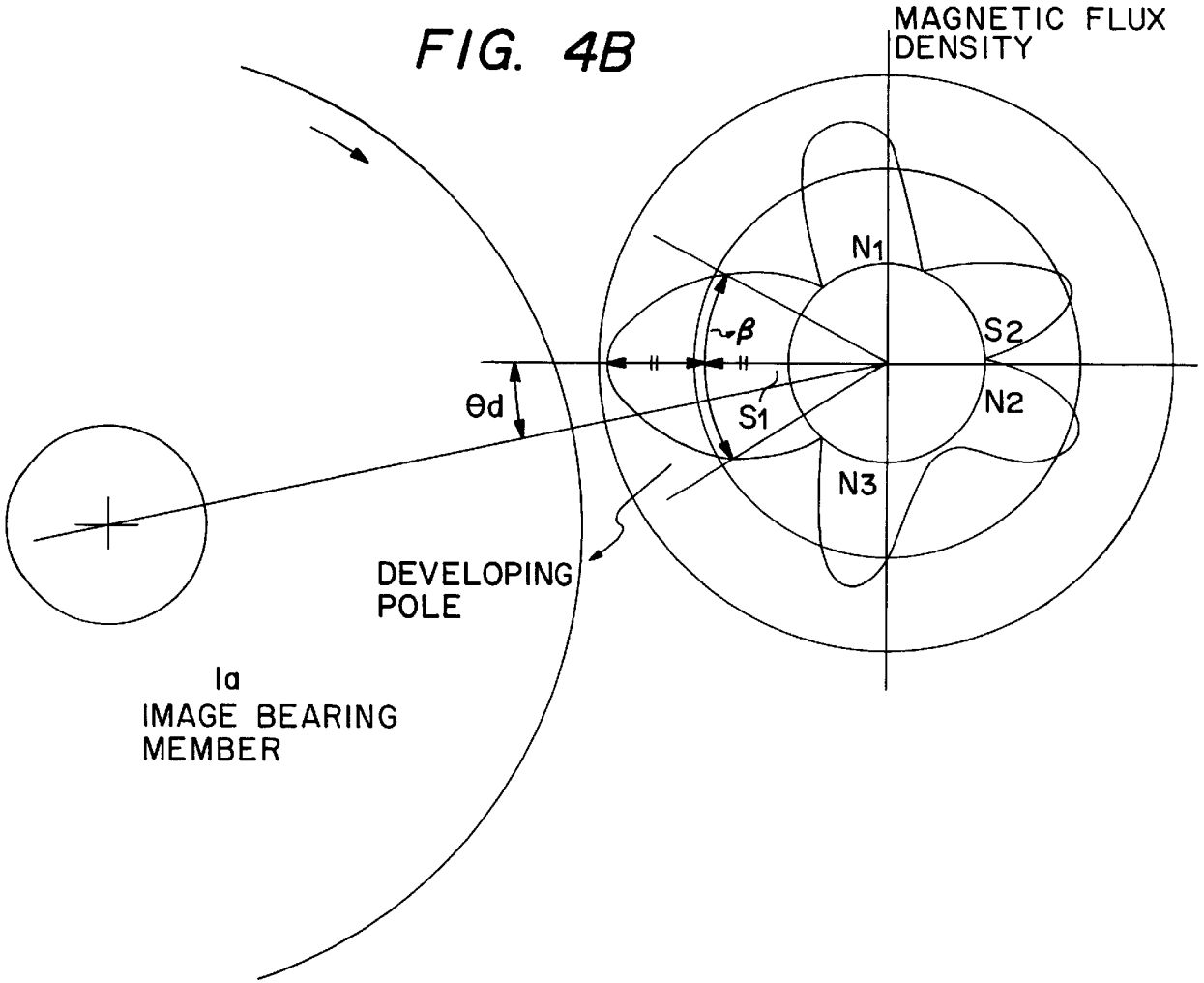

The reason is as follows. As for the injection electrifying, for example, to execute a preferable injection electrifying in the foregoing charged portion, a sufficient injecting time is needed and, consequently, it is necessary that an abutting width between the photosensitive drum and the magnetic particles is widened and the flow velocity of the magnetic particles is high in the abutted portion. To satisfy the conditions, the half-value width a of the charging pole is increased and the angle θc is decreased. When the photosensitive drum surface that is charged under the conditions passes through the developed portion, where the half-value width β is larger than the half-value width α and the angle θd is smaller than the angle θc, the electric charge injecting time of the developed portion is longer than that of the charged portion, the charge of the photosensitive drum surface is reset as shown in FIG. 3, the surface potential of the photosensitive drum is gradually converged to a DC voltage Vdc in the developed portion while the photosensitive drum surface passes through the developed portion.

Unless the relationship between the pole positions (θc, θd) and the relationship between the half-value widths (α, β) simultaneously satisfy the two inequalities, it is difficult to prevent the above-mentioned developing. That is the reason why there is a possibility that the injection efficiency is increased in the developed portion since the flow velocity is high and a magnetic carrier earing (napping) portion is made close to the closest contact point with the photosensitive drum in the case where the pole position is closer to the most adjacent contact point than the charging pole, for example, even under the half-value width α of the charging pole>the half-value width β of the developing pole.

If the range of the half-value width α of the charging pole is too wide, the magnetic carrying force of the magnetic particles may drop and, the density of the magnetic particle layer is, on the contrary, coarse. There may be also a problem such as carrier adhesion.

According to the experiment by the inventors of the present invention, although depending on the diameter of the charging sleeve and the circumferential velocity, preferable injection charging performance is indicated in case of almost 30°<α<70°, preferably, 40°<α<60°. With the developing pole, similarly, the upper limit is determined by image quality such as image ununiformity, carrier adhesion, and the like, and 20°<β<50° is preferable, 30°<β<45° is more preferable, and 25°<β<40° is further more preferable. A preferable result is obtained if θd is also positioned at least on the upstream side in the rotating direction of the photosensitive drum for improvement of carrying performance of the developer or the like.

In the developed portion, the toner actually exists other than the carrier. It is considered that a developing injection current amount is decreased by the proportion of the existing toner. However, the toner density of the developer used generally lies within a range of from 4 to 10% and, according to the experiment by the inventors of the present invention, that the substantial injection current amount is not changed as much for the toner density having the above-mentioned degree as compared with the case of only the carriers and the volume resistivity of the carrier is dominant.

Figure 1:
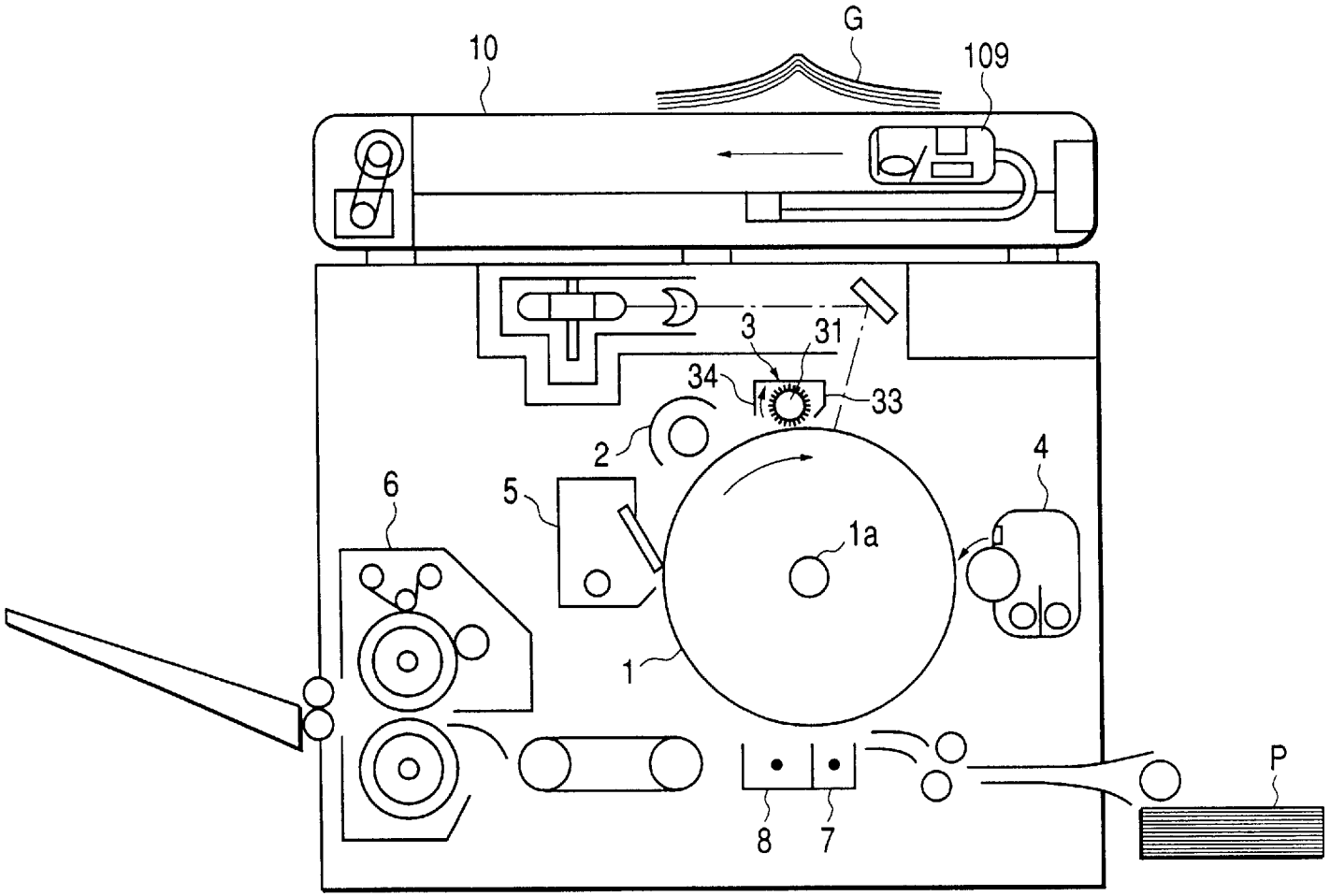
FIG. 1 is a schematic block diagram of an image forming apparatus according to embodiment 1 of the present invention.
Figure 5:
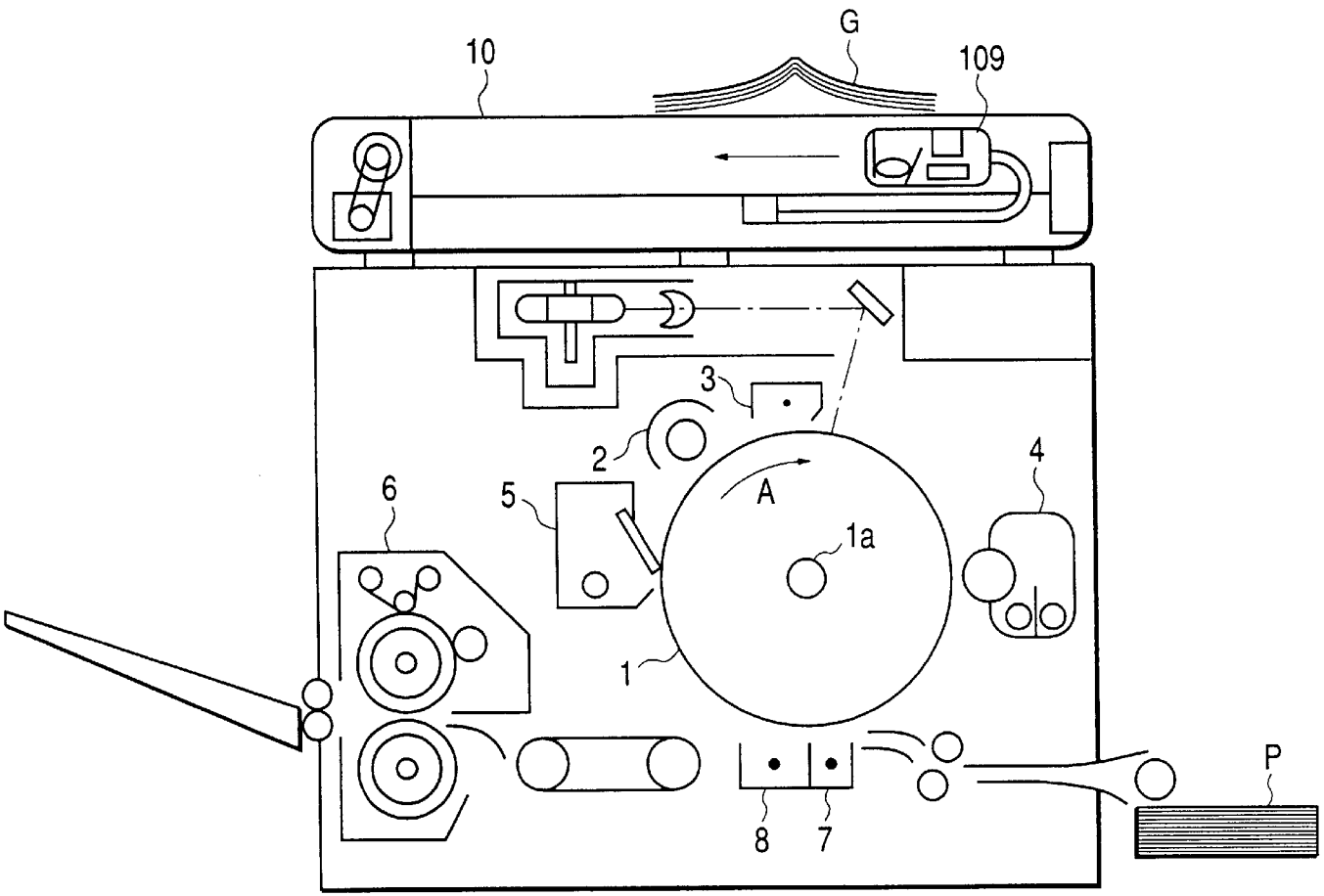
FIG. 5 is a schematic block diagram of an image forming apparatus.
Figure 6:
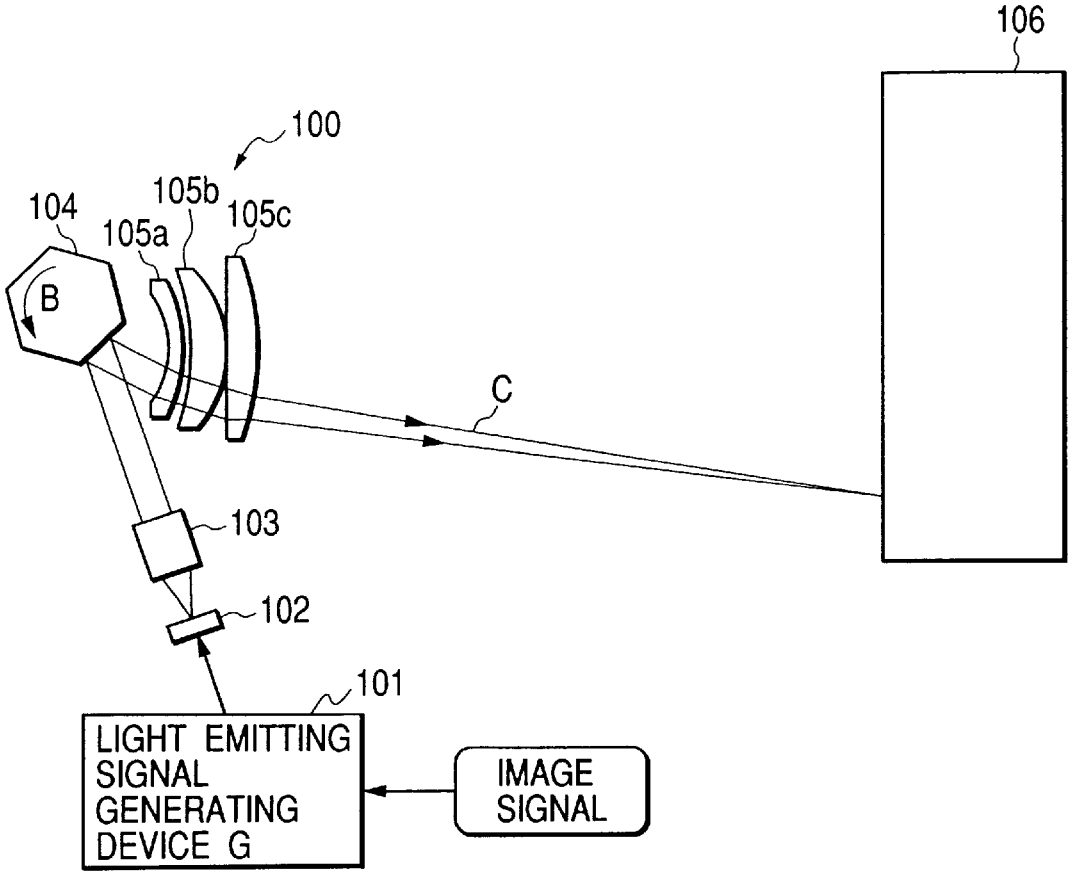
FIG. 6 is a schematic block diagram of a laser scanning unit for scanning laser beams in the image forming apparatus.
Figure 7:
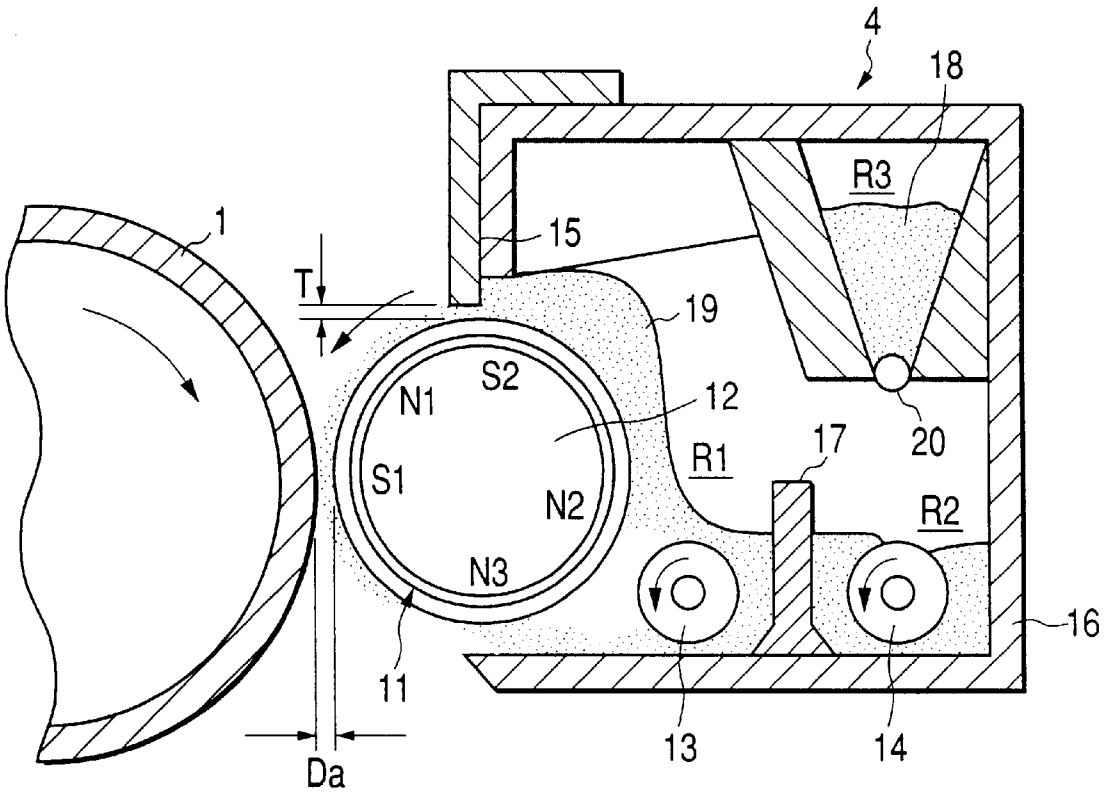
FIG. 7 is a schematic sectional view of the developing device applied to the image forming apparatus.

FIG. 1 is a schematic block diagram showing the image forming apparatus according to the embodiment 1 of the present invention. The same reference numerals denote the same parts as those in the image forming apparatus as an above-mentioned example, shown in FIG. 5, and a repeated description is omitted.

Figure 2:
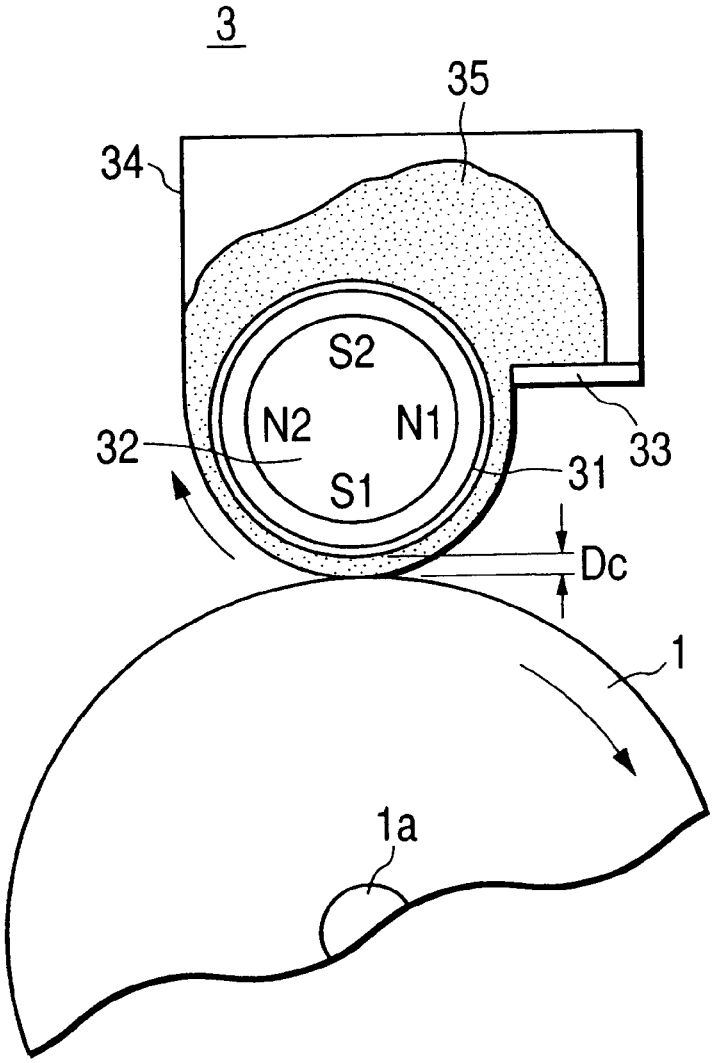
FIG. 2 is a schematic sectional view of a charger in the image forming apparatus according to the present invention.

The charger portion differs as compared with the above-mentioned example. FIG. 2 shows the charger used in the foregoing embodiment. The charger 3 has a sleeve 31 including therein a fixed magnet 32 in a container 34. The charging magnetic particles for injection electrifying on the surface of the sleeve 31 are coated by a regulating member 33. The sleeve 31 is rotated in the direction opposite to the moving direction of the photosensitive drum 1 at a contact portion with the photosensitive drum. In this instance, a distance between the sleeve 31 and the photosensitive drum 1 is almost equal to 500 $\mu$m.

As for the magnetic particles for charging, (1) and (2) can be considered.

(1) Particles obtained by mixing and kneading resin and magnetic powder such as magnetite and forming it into particles or particles obtained by mixing conductive carbon into the foregoing obtained particles for adjusting the value of resistance, and sintered magnetite and ferrite, or particles obtained by reducing or oxidizing the sintered magnetite and ferrite and adjusting the value of resistance.

(2) Particles obtained by coating the foregoing magnetic particles by a coating material whose value of resistance has been adjusted (such as a material obtained by dispersing carbon to phenol resin) or plating the foregoing magnetic particles with the metal such as nickel, thereby having a proper value of resistance or the like. If the value of resistance of the magnetic particles is too high, the charges cannot be uniformly injected to the photosensitive drum and fogged image is obtained due to fine charging defect. If the value of resistance of the magnetic particles is too low, a current is concentrated to a pin hole when there is the pin hole on the photosensitive drum surface, the charging voltage drops, and the surface of the photosensitive body cannot be charged, thereby causing charging defect in a charging-nipped state.

Therefore, the value of resistance of the magnetic particles lies within a range of $1\times10^2$ to $1\times10^{10}$ Ω, preferably, is equal to $1\times10^6$ Ω or more when considering that there is a portion like a pin hole onto the photosensitive drum 1. After inputting charging magnetic particles of 2*g* to a metal cell (the area of the base: 228 $mm^2$) to which a voltage is applied, the value of resistance of the charging magnetic particles is weighted, a voltage of 100 V is applied, and the value of resistance is measured. As for the magnetic characteristics of the charging magnetic particle, preferably, magnetic force of constraint is set to be high to prevent the charging magnetic particles from being adhered to the photosensitive drum 1, and it is desirable that a saturation magnetization is equal to 100 ($emu/cm^3$) or more.

Actually, with respect to the charging magnetic particles used for the example, the mean particle diameter is equal to 30 $\mu$m and the saturation magnetization is equal to 200 ($emu/cm^3$). By applying a bias obtained by superimposing an alternating electric field comprising a sine-wave to a bias of −650 V to the sleeve 31, the photosensitive drum 1 is uniformly charged to a voltage of −650 V. After that, the image is formed in the above-explained steps.

Manufacture of a photosensitive drum A

A drum substrate made of aluminum of ϕ30 mm has an undercoating layer as a first layer. The undercoating layer is a conductive layer having a thickness of 20 $\mu$m to prevent the occurrence of moire due to the reflection of exposure.

A second layer is a positive charge injection preventing layer and functions to prevent a phenomenon that a positive charge injected from the drum substrate removes a negative charge charged to the photosensitive drum surface. The resistance of the second layer is adjusted so as to be equal to about $10^6$ Ω·cm by using Amylan resin and methoxymethylated nylon. The second layer is also an intermediate resistance layer having a thickness of about 0.1 $\mu$m.

A third layer is a charge generating layer that is formed by dispersing pigment of disazo system to resin, has a thickness of about 0.3 $\mu$m, and generates a positive and negative charge pair by exposure.

A fourth layer is a charge transporting layer, formed by dispersing hydrazone to polycarbonate resin, and a p-type semiconductor.

As a fifth layer, there is used a photosensitive drum having a surface layer of 2 $\mu$m that 5 pts.wt. of low-resistance particles such as $SnO_2$ are dispersed to 3 pts.wt. of resin so that polycarbonate rein has a surface resistance. The volume resistivity of the surface layer is equal to $10^{13}$ Ω·cm. The resistance of the surface layer is controlled in this manner, thereby improving the direct charging performance and enabling an image having high quality to be obtained. The photosensitive drum is not limited to an OPC and can also be realized by an a-Si drum, and higher durability can be further realized.

The fourth layer indicates insulation performance of $10^{16}$ Ω·cm or more in terms of volume resistivity for minus charge applied to the photosensitive drum upon forming the image. Therefore, the fourth layer is different from the fifth layer as one feature of the present invention in view of an electric physical property. The volume resistivity of the fourth layer is greater than the fifth layer. The volume resistivity of the surface layer is a measured value after arranging metal electric poles at intervals of 200 $\mu$m, flowing mix solution of the surface layer into the spaces of the intervals, forming a film, applying a voltage of 100 V between the electric poles. The value is measured under conditions of temperature of 23° C. and humidity of 50% RH.

Manufacture of a photosensitive drum B

In place of the surface layer of the fifth layer formed in the manufacture of the photosensitive drum A, as a fifth layer, there is used a photosensitive drum having a surface layer of 2 $\mu$m that 5 pts.wt. of low-resistance particles such as $SnO_2$ are dispersed to 2 pts.wt. of resin so that polycarbonate rein has a surface resistance. The volume resistivity of the surface layer is equal to $10^9$ Ω·cm.

EXAMPLE 1

The above-mentioned photosensitive drum A is used for the image forming apparatus of the embodiment as shown in FIG. 1, an image is formed under the following charging and developing conditions, fog on transfer paper and image density are evaluated.

Charging conditions:

volume resistivity of magnetic particles . . . $1\times10^6$ Ω·cm half-value width of charging pole (α) . . . 60° relationship between the closest contact point with photosensitive drum on charging sleeve and charging pole peak position . . .

angle (θc) formed between peak position and position on downstream side in rotating direction of photosensitive drum; 2° charging bias DC proportion . . . −650 V

AC proportion . . . 700 Vpp, 1000 Hz

Developing condition:

developer . . . non-magnetic toner and ferrite carrier (toner density 6%)

volume resistivity of magnetic carrier . . . $5\times10^6$ Ω·cm half-value width of developing pole (β) . . . 35° relationship between the closest contact point with photosensitive drum on developing sleeve and developing pole peak position . . . angle (θd) formed between peak position and position on upstream side in rotating direction of photosensitive drum; 5° developing bias DC proportion . . . −500 V

AC proportion 2000 . . . Vpp, 2,000 Hz light portion potential . . . −200 V

When an image is formed under the above-mentioned conditions substantially, no fog occurred (at a level A according to a fog evaluating method, which will be explained later on), the image density of 1.5 or more is also obtained, and a preferable image having no coarseness is obtained in the highlight portion.

The fog is obtained by the following method.

Reflecting densities of the fog portion on a transfer paper and a transfer paper before image formation are obtained by DENSITOMETER TC-6DS of TOKYO DENSHOKU Co., Ltd., and by the following equation.

Fog density (%)=(reflecting density on fog portion on transfer paper)−(reflecting density on transfer paper)

Evaluating reference fog density<0.5:

there is substantially no fog . . . level A 0.5≦fog density<1:

there is almost no fog . . . level B

1≦fog density<2:

there is slight fog . . . level C

2≦fog density<3:

there is fog . . . level D

3≦fog density there is fair fog . . . level E

As for image density, the reflecting density on the image transfer paper is measured by a densitometer 941 type produced by X-Rite, Inc.

EXAMPLE 2

The foregoing photosensitive drum A is used for the image forming apparatus of the embodiment 1 as shown in FIG. 1. An image is formed under the following developing conditions, and fog on a transfer paper and image density are evaluated.

Charging conditions:

volume resistivity of magnetic particles . . . $1\times10^6$ Ω·cm half-value width of charging pole (α) . . . 45° relationship between the closest contact point with photosensitive drum on charging sleeve and charging pole peak position . . . angle (θc) formed between peak position and position on downstream side in rotating direction of photosensitive drum; 2° charging bias DC proportion . . . −650 V

AC proportion . . . 700 Vpp, 1,000 Hz

Developing condition:

developer . . . non-magnetic toner and magnetic substance dispersion type resin carrier (toner density 6%)

volume resistivity of magnetic carrier . . . $1\times10^{10}$ Ω·cm half-value width of developing pole (β) . . . 40° relationship between the closest contact point with photosensitive drum on developing sleeve and developing pole peak position . . . angle (θd) formed between peak position and position on upstream side in rotating direction of photosensitive drum; 3° developing bias DC proportion . . . −500 V

AC proportion . . . 2,000 Vpp, 2,000 Hz light portion potential . . . −200 V

When an image is formed under the above-mentioned conditions, almost no fog occurred (at the level B according to the fog evaluating method), the image density of 1.5 or more is also obtained, and a preferable image having no coarseness is obtained in the highlight portion.

EXAMPLE 3

The foregoing photosensitive drum B is used for the image forming apparatus of the embodiment 1 as shown in FIG. 1. An image is formed under the following developing conditions, and fog on transfer paper and image density are evaluated.

Charging conditions:

volume resistivity of magnetic particles . . . $1\times10^6$ Ω·cm half-value width of charging pole (α) . . . 45° relationship between the closest contact point with photosensitive drum on charging sleeve and charging pole peak position . . . angle (θc) formed between peak position and position on downstream side in rotating direction of photosensitive drum; 2° charging bias DC proportion . . . −650 V

AC proportion . . . 700 Vpp, 1,000 Hz

Developing condition:

developer . . . non-magnetic toner and ferrite carrier (toner density 6%)

volume resistivity of magnetic carrier . . . $5\times10^6$ Ω·cm half-value width of developing pole (β) . . . 40° relationship between the closest contact point with photosensitive drum on developing sleeve and developing pole peak position . . . angle (θd) formed between peak position and position on upstream side in rotating direction of photosensitive drum; 3° developing bias DC proportion . . . −500 V

AC proportion . . . 2,000 Vpp, 2,000 Hz light portion potential . . . −200 V

When an image is formed under the above-mentioned conditions, slight fog occurred (at the level C according to the fog evaluating method), the image density of 1.5 or more is also obtained, and a preferable image having no coarseness is obtained in the highlight portion.

COMPARATIVE EXAMPLE 1

The foregoing photosensitive drum A is used for the image forming apparatus of the embodiment 1 as shown in FIG. 1. An image is formed under the following developing conditions, and fog on transfer paper and image density are evaluated.

Charging conditions:

volume resistivity of magnetic particles . . . $1\times10^6$ Ω·cm half-value width of charging pole (α) . . . 40° relationship between the closest contact point with photosensitive drum on charging sleeve and charging pole peak position . . . angle (θc) formed between peak position and position on downstream side in rotating direction of photosensitive drum; 5° charging bias DC proportion . . . −650 V
AC proportion . . . 700 Vpp, 1,000 Hz

Developing condition:

developer . . . non-magnetic toner and ferrite carrier (toner density 6%)

volume resistivity of magnetic carrier . . . $1\times10^6$ Ω·cm half-value width of developing pole (β) . . . 45° relationship between the closest contact point with photosensitive drum on developing sleeve and developing pole peak position . . . angle (θd) formed between peak position and position on upstream side in rotating direction of photosensitive drum; 2° developing bias DC proportion . . . −500 V
AC proportion . . . 2,000 Vpp, 2,000 Hz light portion potential . . . −200 V When an image is formed under the above-mentioned conditions, there is fog (at the level D according to the fog evaluating method), the image density of only 1.3 is obtained, and only an image having low quality and a little coarseness is obtained in the highlight portion.

As explained above, according to the present embodiment, a photosensitive drum is used wherein the volume resistivity of the surface layer for injection electrifying in which the discharging amount is extremely small is adjusted so as to lie within a range of about $10^9$ to $10^{14}$ Ω·cm on charging the photosensitive drum. The magnetic particles are born and carried onto the charging sleeve including therein the magnet, and rubbed near the photosensitive drum opposite portion. Therefore, there are constructed, so as to satisfy the following inequalities, the relationship between the half-value width of the charging pole of the injection charger for injection electrifying and the half-value width of the developing pole of the developing unit for performing the two-component developing under the alternating electric field, and the relationship between the angle formed between the charging pole and the closest point of the charging sleeve and the photosensitive drum on the charging sleeve and the angle formed between the developing pole and the closest point of the developing sleeve and the photosensitive drum on the developing sleeve.

$$(\alpha>\beta) \text{ and } (\theta c<\theta d)$$

(The half-value width of the charging pole is set to α(°), the angle formed between the charging pole peak position and the closest point to the photosensitive drum on the charging sleeve is set to θc(°), the half-value width of the developing pole is set to β(°), and the angle formed between the developing pole peak position and the closest point to the photosensitive drum on the developing sleeve is set to θd(°).) As mentioned above, the optimizing operation is executed. Accordingly, it is possible to obtain the effect that a preferable image is formed without occurring the fog and the decrease in image density.

What is claimed is:

1. An image forming apparatus comprising:

an image bearing member for bearing a latent image, said image bearing member including a surface layer having a volume resistivity of $10^9$ to $10^{14}$ Ω·cm;

a charging member having therein first magnetic field generating means, said charging member bearing charging magnetic particles on an outer surface and making the charging magnetic particles contact with the surface layer of said image bearing member, thereby charging said image bearing member; and a developer bearing member having therein second magnetic field generating means, said developer bearing member bearing a developer having toner and developing magnetic particles on an outer surface, carrying the developer to a developing area, and making the developing magnetic particles contact with the surface layer of said image bearing member in the developing area, thereby developing the latent image, wherein when a half-value width of a first magnetic pole which is closest to said image bearing member of the first magnetic field generating means is set to α°, an angle formed between a straight line connecting between a closest point to said image bearing member on said charging member and a center of said charging member and a straight line connecting between a point of a maximum magnetic flux density of the first magnetic pole on said charging member and the center of said charging member is set to θc°, a half-value width of a second magnetic pole which is closest to said image bearing member of the second magnetic field generating means is set to β°, and an angle formed between a straight line connecting a point which is closest to said image bearing member on said developer bearing member and a center of said developer bearing member and a straight line connecting between a point of a maximum magnetic flux density of the second magnetic pole on said developer bearing member and the center of said image bearing member is set to θd°, α>β and θc<θd are satisfied.

2. An image forming apparatus according to claim 1, wherein the point of the maximum magnetic flux density of the second magnetic pole on said developer bearing member is positioned on the upstream side in a rotating direction of said image bearing member from the closest point to said image bearing member on said developer bearing member.

3. An apparatus according to claim 1, wherein said α lies within a range of $30\leqq\alpha\leqq70$.

4. An apparatus according to claim 1, wherein said β lies within a range of $20\leqq\beta\leqq50$.

5. An apparatus according to claim 1, wherein an alternating electric field is formed at an opposite portion of said charging member and said image bearing member.

6. An apparatus according to claim 1, wherein an alternating electric field is formed at an opposite portion of said developer bearing member and said image bearing member.

7. An apparatus according to claim 1, wherein volume resistivity of the developing magnetic particles borne on said developer bearing member is equal to or less than that of the charging magnetic particles borne on said charging member.

8. An apparatus according to claim 7, wherein the volume resistivity of the charging magnetic particles borne on said charging member lies within a range of $10^6$ to $10^{10}$ Ω·cm.

9. An apparatus according to claim 7, the volume resistivity of the developing magnetic particles borne on said developer bearing member lies within a range of $10^6$ to $10^{13}$ Ω·cm.

* * * * *

UNITED STATES PATENT AND TRADEMARK OFFICE

CERTIFICATE OF CORRECTION

PATENT NO. : 6,219,514 B1
DATED : April 17, 2001
INVENTOR(S) : Yoshiaki Kobayashi et al.

It is certified that error appears in the above-identified patent and that said Letters Patent is hereby corrected as shown below:

Column 1,
Line 46, “la” should read -- la --.

Column 5,
Line 56, “adhering” should read -- adhering to --.

Column 6,
Line 14, “founded” should read -- found --.

Column 7,
Line 4, “be” should be deleted;
Line 63, “pole;” should read -- pole, --;
Line 66, “sleeve;” should read -- sleeve, --; and
Line 67, “pole;” should read -- pole, --.

Column 8,
Line 13, “a” should read -- α --.

Column 10,
Line 64, “drum;” should read -- drum: --.

Column 11,
Line 11, “drum;” should read -- drum: --; and
Line 61, “drum;” should read -- drum: --.

Column 12,
Line 8, “drum;” should read -- drum: --;
Line 34, “drum;” should read -- drum: --; and
Line 48, “drum;” should read -- drum: --.

Column 13,
Line 5, “drum;” should read -- drum: --; and
Line 20, “drum;” should read -- drum: --.

UNITED STATES PATENT AND TRADEMARK OFFICE

CERTIFICATE OF CORRECTION

PATENT NO. : 6,219,514 B1
DATED : April 17, 2001
INVENTOR(S) : Yoshiaki Kobayashi et al.

It is certified that error appears in the above-identified patent and that said Letters Patent is hereby corrected as shown below:

Column 14,
Line 62, "claim 7," should read -- claim 7, wherein --.

Signed and Sealed this

Thirteenth Day of August, 2002

*Attest:*

*Attesting Officer*

JAMES E. ROGAN
*Director of the United States Patent and Trademark Office*